US008505146B1

(12) United States Patent
Jessup

(10) Patent No.: US 8,505,146 B1
(45) Date of Patent: Aug. 13, 2013

(54) AUGER HEAD CLEANOUT SYSTEM

(76) Inventor: Kevin R. Jessup, Holiday, FL (US)

( * ) Notice: Subject to any disclaimer, the term of this patent is extended or adjusted under 35 U.S.C. 154(b) by 256 days.

(21) Appl. No.: 12/927,817

(22) Filed: Nov. 24, 2010

(51) Int. Cl.
*B08B 1/00* (2006.01)

(52) U.S. Cl.
USPC ..... 15/104.33; 15/104.03; 15/104.05; 15/104.31

(58) Field of Classification Search
USPC ..... 15/104.03, 104.05, 104.31, 104.33
See application file for complete search history.

(56) References Cited

U.S. PATENT DOCUMENTS

| | | | | |
|---|---|---|---|---|
| 5,535,473 | A * | 7/1996 | Maniar | 15/104.33 |
| 2010/0017981 | A1 * | 1/2010 | Hamm et al. | 15/104.33 |
| 2012/0110761 | A1 * | 5/2012 | Ripperger et al. | 15/104.05 |

* cited by examiner

*Primary Examiner* — Lee D Wilson
*Assistant Examiner* — Shantese McDonald

(57) ABSTRACT

A line has a proximal end, a distal end and a flexible intermediate extent with a central axis. An auger head has a central base and a plurality of semicircular disks. Each disk has an interior edge coupled to the base. The disks extend generally radially from the base. Each interior edge has an inner end and an outer end. The base has a tapering outer end coextensive the outer ends of the disks. The base has a flat inner end transverse to the axis. Coupling components removably join the distal end of the line and the inner end of the base.

6 Claims, 3 Drawing Sheets

FIG. 3
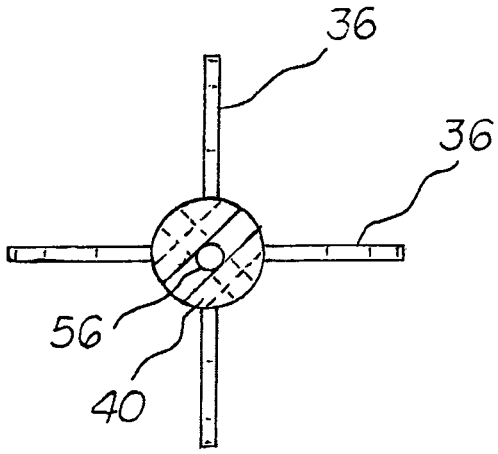
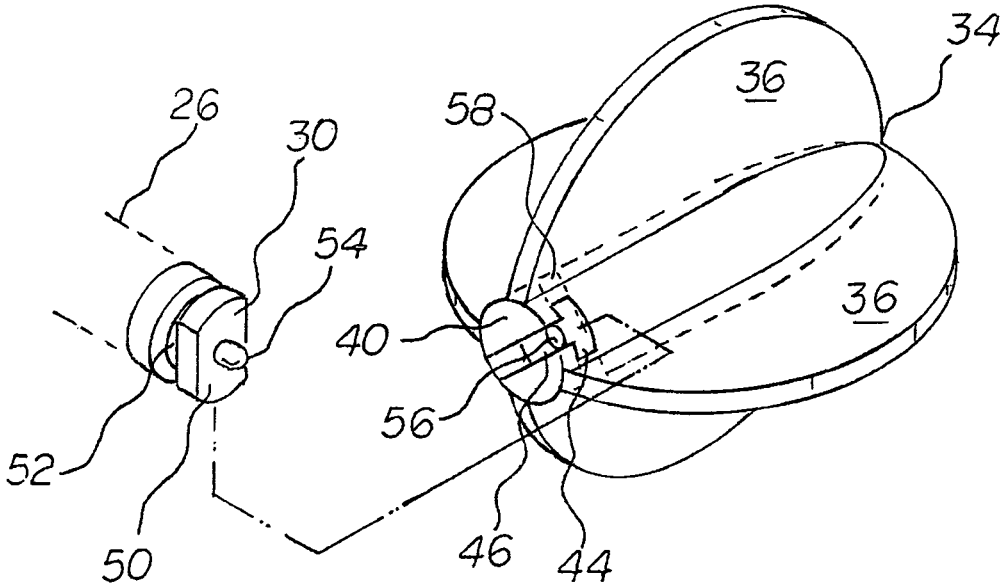
FIG. 4

FIG. 5
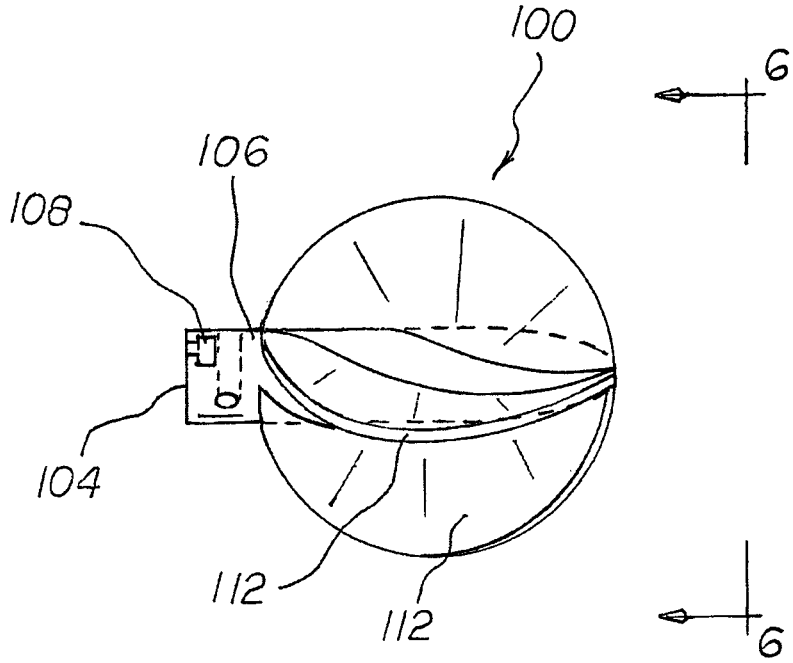
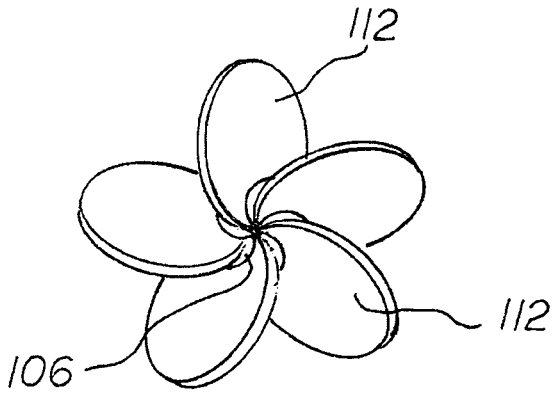
FIG. 6

AUGER HEAD CLEANOUT SYSTEM

BACKGROUND OF THE INVENTION

Field of the Invention

The present invention relates to an auger head cleanout system and more particularly pertains to for floor drains, the system configured to maneuver through U-traps of floor drains while breaking up clogs, the maneuvering and breaking up being done in a safe, reliable, efficient and economical manner.

SUMMARY OF THE INVENTION

In view of the foregoing disadvantages inherent in the known types of cleanout systems of known designs and configurations now present in the prior art, the present invention provide's an improved auger head cleanout system. As such, the general purpose of the present invention, which will be described subsequently in greater detail, is to provide a new and improved auger head cleanout system and method which has all the advantages of the prior art and none of the disadvantages.

To attain this, the present invention essentially comprises an auger head cleanout system. First provided is a floor drain. The floor drain has an initial input extent. The floor drain has an inlet opening. The inlet opening precedes the initial input extent. The floor drain has a following output extent. The floor drain has a U-shaped extent. The U-shaped extent is provided between the input and output extents. The drain has a circular cross section configuration along its entire length. The drain has a diameter of 2 inches, plus or minus 10 percent. The U-shaped extent has a radius of curvature of 4 inches, plus or minus 10 percent.

A flexible line is provided. The flexible line has a proximal end. The proximal end is located above the floor drain. The proximal end is adapted to be rotated by a user. The line has a distal end 30. The distal end is adapted to rotate in response to rotation of the proximal end. The line has a central axis. The central axis extends through the line from the proximal end to the distal end. The distal end is adapted to be moved through the input extent and the U-shaped extent and the output extent while rotating breaking up clogs.

An auger head is provided next. The auger head has a central base. The auger head has four semicircular disks. Each disk has an interior edge. The interior edge is coupled to the base. The disks extend radially from the base at 90 degree increments. Each interior edge is linear and provided parallel with the base over the majority of its length. Each interior edge has an inner end and an outer end. The base has a tapering outer end. The outer end of the base is provided coextensive the outer ends of the disks. The base has a flat inner end. The inner end is provided transverse to the axis and coextensive the inner ends of the disks. The disks have a common radius between 0.50 and 0.75 inches.

Provided last are coupling components. The coupling components removably join the distal end of the line and the inner end of the base. The inner end of the base has a T-shaped diametric slot. The T-shaped slot is formed forwardly of the inner edge of the base. The T-shaped slot has a narrow central region and an upper crossing region. The distal end of the line has an enlarged head. The head is positionable in the upper crossing region. The distal end of the line has a reduced neck. The reduced neck is positionable in the narrow central region. The distal end of the line has an outwardly urged central ball.

The inner end of the base has a hemispherical recess. The recess is adapted to receive the central ball for positioning purposes.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved auger head cleanout system which has all of the advantages of the prior art cleanout systems of known designs and configurations and none of the disadvantages.

It is another object of the present invention to provide a new and improved auger head cleanout system which may be easily and efficiently manufactured and marketed.

It is further object of the present invention to provide a new and improved auger head cleanout system which is of durable and reliable constructions.

An even further object of the present invention is to provide a new and improved auger head cleanout system which is susceptible of a low cost of manufacture with regard to both materials and labor, and which accordingly is then susceptible of low prices of sale to the consuming public, thereby making such auger head cleanout system economically available to the buying public.

Even still another object of the present invention is to provide an auger head cleanout system for floor drains, the system configured to maneuver through U-traps of floor drains while breaking up clogs, the maneuvering and breaking up being done in a safe, reliable, efficient and economical manner.

Lastly, it is an object of the present invention to provide new and improved auger head cleanout system. A line has a proximal end, a distal end and a flexible intermediate extent with a central axis. An auger head has a central base and a plurality of semicircular disks. Each disk has an interior edge coupled to the base. The disks extend generally radially from the base. Each interior edge has an inner end and an outer end. The base has a tapering outer end coextensive the outer ends of the disks. The base has a flat inner end transverse to the axis. Coupling components removably join the distal end of the line and the inner end of the base.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a cross sectional view taken along line 3-3 of FIG. 2.

FIG. 4 is an exploded perspective illustration of the coupling components of FIGS. 1 through 3.

FIG. 5 is an enlarged side elevational view of an auger head similar to FIG. 2 but illustrating an alternate embodiment of the invention.

FIG. 6 is an end elevational view taken along long 6-6 of FIG. 5.

The same reference numerals refer to the same parts throughout the various Figures.

DESCRIPTION OF THE PREFERRED EMBODIMENT

Figure 1:
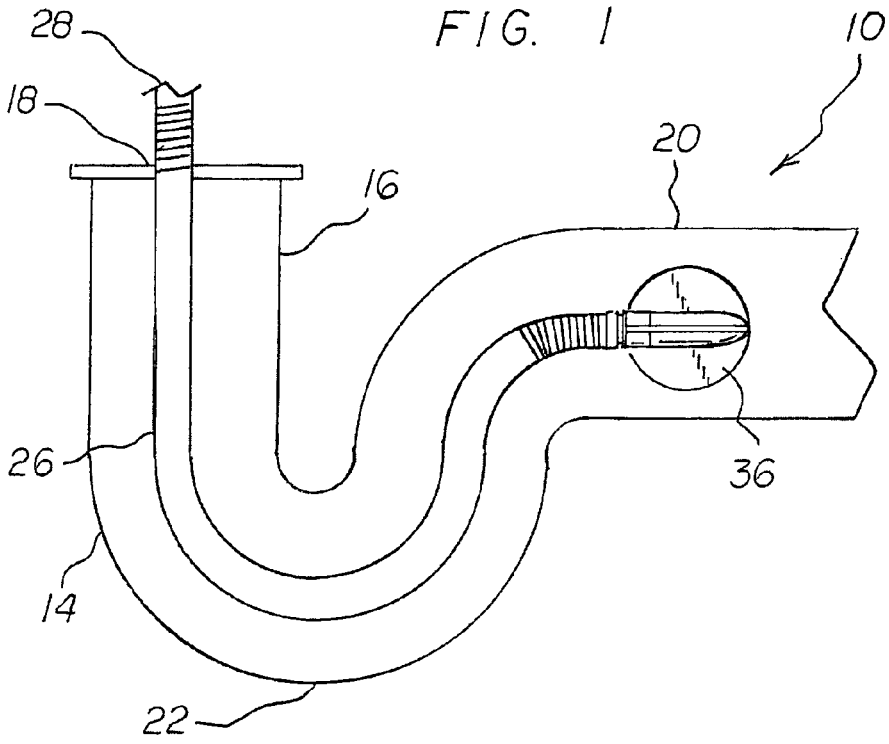
FIG. 1 is side elevational view of an auger head cleanout system for floor drains constructed in accordance with the principles of the present invention.
Figure 2:
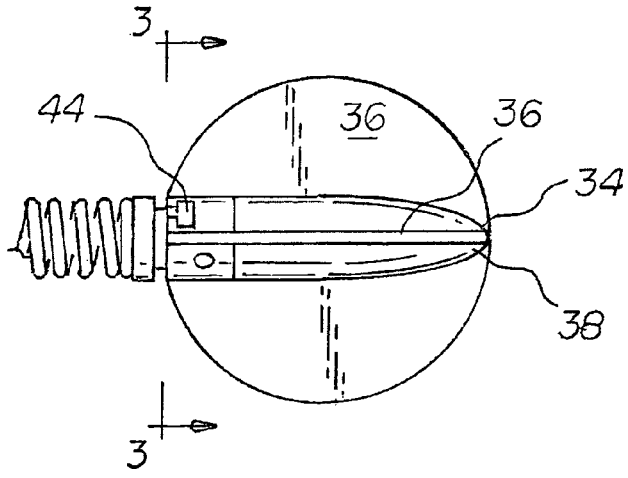
FIG. 2 is an enlarged side elevational view of the auger head shown in FIG. 1.

With reference now to the drawings, and in particular to FIG. 1 thereof, the preferred embodiment of the new and improved auger head cleanout system embodying the principles and concepts of the present invention and generally designated by the reference numeral 10 will be described.

The present invention, the auger head cleanout system 10 is comprised of a plurality of components. Such components in their broadest context include a line, an auger and coupling components. Such components are individually configured and correlated with respect to each other so as to attain the desired objective.

First provided is a floor drain 14. The floor drain has an initial input extent 16. The floor drain has an inlet opening 18. The inlet opening precedes the initial input extent. The floor drain has a following output extent 20. The floor drain has a U-shaped extent 22. The U-shaped extent is provided between the input and output extents. The drain has a circular cross section configuration along its entire length. The drain has a diameter of 2 inches, plus or minus 10 percent. The U-shaped extent has a radius of curvature of 4 inches, plus or minus 10 percent.

A flexible line 26 is provided. The flexible line has a proximal end 28. The proximal end is located above the floor drain. The proximal end is adapted to be rotated by a user. The line has a distal end 30. The distal end is adapted to rotate in response to rotation of the proximal end. The line has a central axis. The central axis extends through the line from the proximal end to the distal end. The distal end is adapted to be moved through the input extent and the U-shaped extent and the output extent while rotating breaking up clogs.

An auger head 34 is provided next. The auger head has a central base 36. The auger head has four semicircular disks 37. Each disk has an interior edge. The interior edge is coupled to the base. The disks extend radially from the base at 90 degree increments. Each interior edge is linear and provided parallel with the base over the majority of its length. Each interior edge has an inner end and an outer end. The base has a tapering outer end 38. The outer end of the base is provided coextensive the outer ends of the disks. The base has a flat inner end 40. The inner end is provided transverse to the axis and coextensive the inner ends of the disks. The disks have a common radius between 0.50 and 0.75 inches.

Provided last are coupling components. The coupling components removably join the distal end of the line and the inner end of the base. The inner end of the base has a T-shaped diametric slot 44. The T-shaped slot is formed forwardly of the inner edge of the base. The T-shaped slot has a narrow central region 46 and an upper crossing region 48. The distal end of the line has an enlarged head 50. The head is positionable in the upper crossing region. The distal end of the line has a reduced neck 52. The reduced neck is positionable in the narrow central region. The distal end of the line has an outwardly urged central ball 54. The inner end of the base has a hemispherical recess. The recess is adapted to receive the central ball for positioning purposes.

Reference is now made to the alternate embodiment 100 of the invention illustrated in FIGS. 5 and 6. A base 106 is provided. The base has an inner end 104. The base has a T-shaped diametric slot 108. The T-shaped slot is formed rearwardly of the inner edge of the disks. The T-shaped slot has a narrow central region 110. The T-shaped slot has an upper crossing region 112. The distal end of the line has an enlarged head 114. The head is positionable in the upper crossing region. The distal end of the line also has a reduced neck 116. The reduced neck is positionable in the narrow central region.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An auger head cleanout system comprising:

a line having a proximal end and a distal end and a flexible intermediate extent with a central axis extending through the line from the proximal end to the distal end;

an auger head formed of a central base and a plurality of semicircular disks, each disk having an interior edge coupled to the central base, the disks extending generally radially from the central base, each interior edge having an inner end and an outer end, the central base having a tapering outer end coextensive the outer ends of the disks, the central base having a flat inner end transverse to the central axis; and coupling components removably joining the distal end of the line and the inner end of the central base.

2. The system as set forth in claim 1 for use in a floor drain with a U-shaped extent, the floor drain having a circular cross sectional configuration with a first diameter, and wherein the disks have a second diameter the second diameter being between 50 and 75 percent of the first diameter.

3. The system as set forth in claim 1 wherein the flat inner end of the central base is formed with a T-shaped diametric slot, the T-shaped slot being formed forwardly of the inner edge of the central base, the T-shaped slot having a narrow central region and an upper crossing region, the distal end of the line being formed with an enlarged head positionable in the upper crossing region and a reduced neck positionable in the narrow central region, the distal end of the line being formed with an outwardly urged central ball, the flat inner end of the central base having a hemispherical recess adapted to receive the central ball for positioning purposes.

4. The system (100) as set forth in claim 1 wherein the flat (104) of the central base (106) is formed with a T-shaped diametric slot (108), the T-shaped slot being formed rearwardly of the inner edge of the disks, the T-shaped slot having a narrow central region (110) and an upper crossing region (112), the distal end of the line being formed with an enlarged head (114) positionable in the upper crossing region, the distal end of the line also formed with a reduced neck (116) positionable in the narrow central region.

5. The system as set forth in claim 1 wherein the disks (120) are attached to the central base and extend generally radially from the central base in a spiraling configuration.

6. An auger head cleanout system (10) for use in a floor drain (14) having an initial input extent (16) preceded by an inlet opening (18), the floor drain having a following output extent (20), the floor drain having a U-shaped extent (22) between the input and output extents, the drain having a circular cross section configuration along its entire length with a diameter of 2 inches, plus or minus 10 percent, the U-shaped extent having a radius of curvature of 4 inches, plus or minus 10 percent, the system comprising, in combination:

a flexible line (26) having a proximal end (28) located above the floor drain and adapted to be rotated by a user, the line having a distal end (30) adapted to rotate in response to rotation of the proximal end, a central axis extending through the line from the proximal end to the distal end, the distal end adapted to be moved through the input extent and the U-shaped extent and the output extent while rotating breaking up clogs;

an auger head (34) formed of a central base (36) and four semicircular disks (37), each disk having an interior edge coupled to the central base, the disks extending radially from the central base at 90 degree increments, each interior edge being linear and parallel with the central base over the majority of its length, each interior edge having an inner end and an outer end, the central base having a tapering outer end (38) coextensive the outer ends of the disks, the central base having a flat inner end (40) transverse to the central axis and coextensive the inner ends of the disks, the disks having a common radius between 0.50 and 0.75 inches; and coupling components removably joining the distal end of the line and the flat inner end of the central base, the flat inner end of the central base formed with a T-shaped diametric slot (44), the T-shaped slot having a narrow central region (46) and an upper crossing region (48), the distal end of the line being formed with an enlarged head (50) positionable in the upper crossing region and a reduced neck (52) positionable in the narrow central region, the distal end of the line being formed with an outwardly urged central ball (54), the flat inner end of the central base having a hemispherical recess adapted to receive the central ball for positioning purposes.

* * * * *